United States Patent [19]

Freeman et al.

[11] Patent Number: 4,737,439

[45] Date of Patent: Apr. 12, 1988

[54] PHOTOGRAPHIC COMPOSITIONS AND ELEMENTS INCLUDING INTERNAL LATENT IMAGE SILVER HALIDE GRAINS AND NUCLEATING AGENTS THEREFOR

[75] Inventors: John P. Freeman, Beverly, Mass.; Roy L. Orvis, Rochester; Richard L. Parton, Webster; Karl E. Wiegers, Rochester, all of N.Y.

[73] Assignee: Eastman Kodak Company, Rochester, N.Y.

[21] Appl. No.: 890,205

[22] Filed: Jul. 28, 1986

[51] Int. Cl.[4] ..... G03C 1/06

[52] U.S. Cl. ..... 430/212; 430/217; 430/223; 430/598; 430/410

[58] Field of Search ..... 430/598, 212, 410, 217, 430/223

[56] References Cited

U.S. PATENT DOCUMENTS

| | | | |
|---|---|---|---|
| 3,347,671 | 10/1967 | Salminen | 96/3 |
| 3,615,615 | 10/1971 | Lincoln et al. | 96/109 |
| 4,030,925 | 6/1977 | Leone et al. | 96/73 |
| 4,306,016 | 12/1981 | Baralle et al. | 430/598 |

FOREIGN PATENT DOCUMENTS 1269640 4/1972 United Kingdom .

*Primary Examiner*—Won H. Louie

*Attorney, Agent, or Firm*—William J. Davis

[57] ABSTRACT

A radiation-sensitive composition including silver halide grains capable of forming an internal latent image and a nucleating agent is useful as a coating on a support to form a photographic element.

7 Claims, No Drawings

PHOTOGRAPHIC COMPOSITIONS AND ELEMENTS INCLUDING INTERNAL LATENT IMAGE SILVER HALIDE GRAINS AND NUCLEATING AGENTS THEREFOR

BACKGROUND OF THE INVENTION

1. Field of the Invention

The present invention is directed to novel radiation sensitive compositions and their use in photographic elements. More specifically, this invention is directed to such elements and compositions including nucleating agents and silver halide grains capable of forming internal latent images.

2. Description Relative to the Prior Art

Photographic elements which produce images having an optical density directly related to the radiation received on exposure are said to be negative working. A positive photographic image can be formed by producing a negative photographic image and then forming a second photographic image which is a negative of the first negative—that is, a positive image. The advantage of forming a positive photographic image directly has long been appreciated in the art. A direct-positive image is understood in photography to be a positive image that is formed without first forming a negative image.

A conventional approach to forming direct-positive images is to use photographic elements employing internal latent image forming silver halide grains. After imagewise exposure, the silver halide grains are developed with a surface developer—that is, one that will leave the latent image sites within the silver halide grains substantially unrevealed. Simultaneously, either by uniform light exposure or by the use of a nucleating agent, the silver halide grains are subjected to development conditions that would cause fogging of a negative-working Photographic element. The internal latent image forming silver halide grains which received actinic radiation during imagewise exposure develop under these conditions at a comparatively slow rate as compared to the internal latent image forming silver halide grains not exposed. The result is a direct-positive silver image. In color photography the oxidized developer that is produced during development is used to produce a corresponding positive dye image. Multicolor direct positive photographic images based on the above-described "internal image reversal" process have been investigated extensively in connection with image-transfer photography.

The term "nucleating agent" is employed herein in its art recognized usage to mean a fogging agent capable of permitting the selective development of internal image forming silver halide grains which have not been imagewise exposed, in preference to the development of silver halide grains having an internal latent image formed by imagewise exposure. Nucleating agents are fogging agents which perform essentially the same function achieved by uniform light exposure during development in internal image reversal processes.

Substituted hydrazines have been extensively investigated as nucleating agents for forming direct-positive photographic images with internal latent image emulsions. Illustrative patents directed to the use of hydrazines in forming direct-positive photographic images are Ives U.S. Pat. Nos. 2,563,785 and 2,588,982, issued Aug. 7, 1951 and Mar. 11, 1952, respectively; Whitmore U.S. Pat. No. 3,227,552, issued Jan. 4, 1966; and Knott and Williams British Patent No. 1,269,640, published Apr. 6, 1972. Ives as well as Knott and Williams teach the incorporation of their nucleating agents in photographic developers. The nucleating agents of Whitmore can be incorporated directly within a photographic element or in an image-receiving element as well as in the photographic developer. Whitmore teaches the use of substituted hydrazine nucleating agents in image transfer type photographic elements.

Another class of useful nucleating agents are the acylhydrazinophenylthioureas disclosed by Leone, Weber and Wrathall U.S. Pat. No. 4,030,925, issued June 21, 1977.

In considering the formation of direct-positive photographic images using conventional substituted hydrazine nucleating agents of the type disclosed above, a number of disadvantages have been identified. One disadvantage has stemmed from the tendency of incorporated hydrazine derivatives when used in conventional large quantities to liberate nitrogen gas in the course of nucleating silver halide. The liberated gas can result in bubbles being trapped within the binder for the photographic element. The bubbles can produce optical distortions or even cause discontinuities in one or more layers of the photographic element, thereby degrading the photographic image.

Another approach toward finding useful nucleating agents has been to synthesize heterocyclic nitrogen quaternary salts, such as disclosed by Kurtz and Harbison U.S. Pat. No. 3,734,738, issued May 22, 1973, and Kurtz and Heseltine U.S. Pat. No. 3,719,494, issued Mar. 6, 1973. Similarly, Lincoln and Heseltine U.S. Pat. Nos. 3,615,615 and 3,759,901, issued Apr. 13, 1970 and Sept. 18, 1973, teach the use of novel N-hydrazonoalkyl substituted heterocyclic nitrogen quaternary salts as nucleating agents. While these heterocyclic nucleating agents have reduced the concentrations required somewhat, they have generally shared the above-described disadvantages of substituted hydrazine nucleating agents. Further, these quaternary salts can be disadvantageous in absorbing light within the visible spectrum.

U.S. Pat. No. 3,347,671 issued Oct. 17, 1967 to W. M. Salminen discloses reductone derivatives useful as fogging agents for use in conjunction with silver halide emulsions that form latent images predominantly inside the silver halide grains when such emulsions are utilized in color diffusion transfer processes.

SUMMARY OF THE INVENTION

This invention has as its purpose to provide photographic compositions and elements, useful in forming direct-positive images, which obviate optical distortions due to nitrogen gas liberation. Further, this invention has as its purpose providing photographic compositions and elements having a novel class of nucleating agents directly incorporated therein rather than in a developer composition. These nucleating agents can be adsorbed to the surface of internal latent-image forming silver halide grains, but they do not absorb visible light. This invention further provides an advantage in allowing combinations of nucleating agents to be employed to control the speed of direct-positive silver halide compositions and elements.

Thus, in its broadest aspect the present invention provides a radiation-sensitive silver halide emulsion comprising a binder, silver halide grains capable of forming an internal latent image when coated in a photographic element and exposed to actinic radiation, and a nucleating amount of a nucleating agent having the formula:

$$R^1—Y—R^2 \quad (I)$$

wherein $R^1$ and $R^2$ independently represent a heterocyclic group having at least one nitrogen ring atom;

Y is $-CH(R^3{-}O)-C(=O)-$ or $-C(R^3{-}O)=C(O{-}R^4)-$ where $R^3$ is a $-C(=O)-R^5$ group or a $-C(=O)-C(=O)-R^5$ group;

$R^4$ is H, a $-C(=O)-R^5$ group or a $-C(=O)-C(=O)-R^5$ group;

and $R^5$ is alkyl, alkoxy, aryl, or aralkyl.

The described composition is useful as a coating on a support to form a photographic element.

In one preferred embodiment of the invention there is provided a radiation sensitive photographic element comprising a support having thereon a layer comprising the silver halide photographic emulsion described above.

In another embodiment, there is provided a photographic diffusion transfer element comprising a support having thereon a layer comprising a redox dye-releasing compound having associated therewith an internal latent image silver halide emulsion comprising a binder, internal latent image silver halide grains and a nucleating amount of the above-described nucleating agent of this invention.

In yet another embodiment of the invention, there is provided a photographic film unit comprising (a) an integral imaging receiver element comprising a support, an internal latent image silver halide emulsion comprising a binder, internal latent image silver halide grains and a nucleating amount of the above-described nucleating agent of this invention, a redox dye-releasing compound associated with said emulsion, and a dye image receiving layer; (b) a cover sheet comprising a timing layer, a neutralizing layer and a support; and (c) means for discharging an aqueous alkaline processing composition between the integral imaging receiver element and the cover sheet.

DESCRIPTION OF PREFERRED EMBODIMENTS

In accordance with the present invention, there is provided a radiation-sensitive silver halide emulsion comprising a binder, silver halide grains capable of forming an internal latent image when coated in a photographic element and exposed to actinic radiation, and a nucleating amount of a nucleating agent represented by formula (I) above.

$R^1$ and $R^2$ in formula (I) set forth above independently represent a heterocyclic group having at least one nitrogen ring atom. The nitrogen ring atom is believed to promote adsorption of the nucleating agent onto the silver halide grains. Each heterocyclic group preferably has a total of up to 18, and most preferably, up to 12 ring atoms. Specifically contemplated heterocyclic groups include pyridyl (i.e., 2-pyridyl or 3-pyridyl), pyrazinyl, quinolyl, benzimidazolyl, triazinyl, pyrazolyl, pyrimidyl, and pyrrolidyl; or an alkyl, halo, cyano or alkoxy substituted heterocyclic group or an equivalent thereof. Exemplary of preferred substituents are alkoxy substituents having from 1 to 6 carbon atoms, alkyl substituents having from 1 to 6 carbon atoms, and cyano-, fluoro-, chloro-, bromo- and iodo-substituents. It is specifically contemplated that $R^1$ and $R^2$ can be substituted with other substituents which are known in the art to promote adsorption to the silver halide grains, such as a sulfo or oxalate radical or a radical derived from a thioketone, a thiourea, a thiocarbamate, a urethane or a thiourethane.

As noted above, Y in formula (I) is $-CH(R^3{-}O)-C(=O)-$ or $-C(R^3{-}O)=C(O{-}R^4)-$ wherein $R^3$ is a $-C(=O)-R^5$ group or a $-C(=O)-C(=O)-R^5$ group;

$R^4$ is H, a $-C(=O)-R^5$ group or a $-C(=O)-C(=O)-R^5$ group;

and $R^5$ is alkyl, alkoxy, aryl or aralkyl.

In one specifically contemplated form, $R^5$ is an alkyl group having a total of up to 18 carbon atoms, preferably up to 12 carbon atoms. Specifically, $R^5$ can take the form of a methyl, ethyl, propyl, butyl, pentyl, hexyl, heptyl, octyl, nonyl, decyl or higher homologue group having up to 18 carbon atoms and isomers thereof; a cyano-, fluoro-, bromo-, or iodo-substituted derivative thereof; or a methoxy, ethoxy, propoxy, butoxy or higher homologue alkoxy substituted derivative thereof, wherein the total number of carbon atoms are necessarily at least 2 up to about 18.

$R^5$ can take the form of an alkoxy group having a total of up to 18 carbon atoms, preferably up to 6 carbon atoms such as methoxy, ethoxy, propoxy, butoxy or higher homologue alkoxy derivative. The alkoxy group can be a cyano- or halo-substituted derivative. It is also contemplated that $R^5$ can take the form of an aryl group having a total of up to 18 carbon atoms, preferably up to 12 carbon atoms, such as phenyl, naphthyl or anthracenyl. The preferred aryl group is phenyl. The aryl group can be a cyano-, fluoro-, chloro-, bromo-, or iodo-substituted derivative, or a methoxy, ethoxy, propoxy, butoxy or higher homologue alkoxy substituted derivative, the alkoxy portion of which preferably contains from 1 to 6 carbon atoms.

In addition to the aliphatic and aromatic forms of $R^5$ discussed above, it is also contemplated that $R^5$ can take the form of an aralkyl substituent having a total of up to 18 carbon atoms, preferably up to 12 carbon atoms, such as benzyl. As is the case when $R^5$ is alkyl or aryl, the aralkyl group can be a cyano-, fluoro-, chloro-, bromo-, or iodo-substituted derivative, or a methoxy, ethoxy, propoxy, butoxy or higher homologue substituted derivative, the alkoxy portion of which preferably contains from 1 to 6 carbon atoms.

Furthermore, it is specifically contemplated that $R^5$ can be substituted with other substituents which are known in the art to promote adsorption to the silver halide grains, such as a sulfo or oxalate radical or a radical derived from a thioketone, a thiourea, a thiocarbamate, a urethane or a thiourethane.

The nucleating agents of this invention are known compounds and can be prepared by methods known in the art. The numerous examples set forth hereinbelow illustrate such known methods.

Illustrative specific nucleating agents within the scope of formula I which are useful in the practice of this invention include those set forth below in Table I.

TABLE I

| | |
|---|---|
| NA-1 | 2-acetoxy-1,2-di-(2-pyridyl)ethanone |
| NA-2 | 2-acetoxy-1,2-di-(3-pyridyl)ethanone |
| NA-3 | 2-benzoxy-1,2-di-(2-pyridyl)ethanone |
| NA-4 | 1,2-didecanoyloxy-1,2-di-(2-pyridyl)ethene |
| NA-5 | 2-chloroacetoxy-1,2-di-(2-pyridyl)ethanone |
| NA-6 | 2-(4-cyanobenzoxy)-1,2-di-(3-pyridyl)ethanone |
| NA-7 | 2-acetoxy-1,2-di-(6-methyl-2-pyridyl)ethanone |
| NA-8 | 2-acetoxy-1,2-di-(2-quinolyl)ethanone |
| NA-9 | 2-acetoxy-1-(2-pyridyl)-2-(2-quinolyl)ethanone |
| NA-10 | 1,2-diacetoxy-1,2-di-(2-pyridyl)ethene |
| NA-11 | 1,2-dibenzoxy-1,2-di-(2-pyridyl)ethene |
| NA-12 | 1,2-diacetoxy-1,2-dipyrazinylethene |
| NA-13 | 2-ethyloxaloxy-1,2-di-(2-pyridyl)ethanone |

The nucleating agents of this invention can be employed with any conventional photographic element capable of forming a direct-positive image containing at least one radiation-sensitive layer containing silver halide grains capable of forming an internal latent image upon exposure to actinic radiation. As employed herein, the terms "internal latent image silver halide grains" and "silver halide grains capable of forming an internal latent image" are employed in the art-recognized sense of designating silver halide grains which produce substantially higher optical densities when coated, imagewise exposed and developed in an internal developer than when comparably coated, exposed and developed in a surface developer. Preferred internal latent image silver halide grains are those which when examined according to normal photographic testing techniques, by coating a test portion on a photographic support at a density of from 3 to 4 grams/$m^2$, exposing to a light intensity scale (such as, for example, with a 500 watt tungsten lamp at a distance of 61 cm) for a fixed time between $1\times10^{-2}$ and 1 second and developing for 5 minutes at 25° C. in Kodak Developer DK-50 (a surface developer) provide a density of at least 0.5 density units less than when this testing procedure is repeated substituting for the surface developer Kodak Developer DK-50 containing 0.5 gram per liter of potassium iodide (an internal developer). The internal latent image silver halide grains most preferred for use in the practice of this invention are those which when tested using an internal developer and a surface developer as indicated above produce an optical density with the internal developer at least 5 times that produced by the surface developer. It is additionally preferred that the internal latent image silver halide grains produce an optical density of less than 0.4 and, most preferably, less than 0.25 when coated, exposed and developed in surface developer as indicated above—that is, the silver halide grains are initially substantially unfogged and free of latent image on their surface.

The surface developer referred to herein as Kodak Developer DK-50 is described in the Handbook of Chemistry and Physics, 30th ed., 1947, Chemical Rubber Publishing Co., Cleveland, Ohio, p. 2558, and has the following composition:

| | |
|---|---|
| Water, about 125° F. (52° C.) | 500.0 cc |
| N—methyl-p-aminophenol sulfate | 2.5 g |
| Sodium sulfite, desiccated | 30.0 g |
| Hydroquinone | 2.5 g |
| Sodium metaborate | 10.0 g |
| Potassium bromide | 0.5 g |
| Water to make | 1.0 liter |

Internal latent image silver halide grains which can be employed in the practice of this invention are well known in the art. Patents teaching the use of internal latent image silver halide grains in photographic emulsions and elements include Davey et al. U.S. Pat. No. 2,592,250, issued May 8, 1952; Porter et al. U.S. Pat. No. 3,206,313, issued Sept. 14, 1965; Milton U.S. Pat. No. 3,761,266, issued Sept. 25, 1973; Ridgway U.S. Pat. No. 3,586,505, issued June 22, 1971; Gilman et al. U.S. Pat. No. 3,772,030, issued Nov. 13, 1973; Gilman et al. U.S. Pat. No. 3,761,267, issued Sept. 25, 1973; and Evans U.S. Pat. No. 3,761,276, issued Sept. 25, 1973, the disclosures of which are here incorporated by reference.

The internal latent image silver halide grains preferably contain bromide as the predominant halide. The silver bromide grains can consist essentially of silver bromide or can contain silver bromoiodide, silver chlorobromide, silver chlorobromoiodide crystals and mixtures thereof. Internal latent image forming sites can be incorporated into the grains by either physical or chemical internal sensitization. Davey et al., cited above, for example, teaches the physical formation of internal latent image forming sites by the halide conversion technique. Chemical formation of internal latent image forming sites can be produced through the use of sulfur, gold, selenium, tellurium and/or reduction sensitizers of the type described, for example, in Sheppard et al. U.S. Pat. No. 1,623,499, issued Apr. 5, 1927; Waller et al. U.S. Pat. No. 2,399,083, issued Apr. 23, 1946; McVeigh U.S. Pat. No. 3,297,447, issued Jan. 10, 1967 and Dunn U.S. Pat. No. 3,297,446, issued Jan. 10, 1967, as taught in the patents cited in the preceding paragraph. Internal latent image sites can also be formed through the incorporation of metal dopants, particularly Group VIII platinum metals such as ruthenium, rhodium, palladium, iridium, osmium and platinum, as taught by Berriman U.S. Pat. No. 3,367,778, issued Feb. 6, 1968. The preferred foreign metal ions are polyvalent metal ions which include the above noted Group VIII dopants as well as polyvalent metal ions such as lead, antimony, bismuth, arsenic and the like. In highly preferred embodiments, the silver halide grains are formed in the presence of bismuth, lead or iridium ions. In a preferred approach the internal latent image sites can be formed within the silver halide grains during precipitation of silver halide. In an alternate approach a core grain can be formed which is treated to form the internal image sites and then a shell deposited over the core grains, as taught by Porter et al., cited above.

The silver halide grains employed in the practice of this invention are preferably monodispersed, and in some embodiments are preferably large-grain emulsions made according to Wilgus, German OLS 2,107,118, published Sept. 2, 1971, which is incorporated herein by reference. The monodispersed emulsions are those which comprise silver halide grains having a substantially uniform diameter. Generally, in such emulsions, no more than about 5 percent, by weight, of the silver halide grains smaller than the mean grain size and/or no more than about 5 percent, by number, of the silver halide grains larger than the mean grain size vary in diameter from the mean grain diameter by more than about 40 percent. Preferred photographic emulsions of this invention comprise silver halide grains, at least 95 perent, by weight, of said grains having a diameter which is within 40 percent, preferably within about 30 percent, of the mean grain diameter. Mean grain diameter, i.e., average grain size, can be determined using conventional methods, e.g. such as projective area as shown in an article by Trivelli and Smith entitled "Empirical Relations between Sensitometric and Size-Frequency Characteristics in Photographic Emulsion Series" in The Photographic Journal, Vol. LXXIX, 1939, pp. 330–338. The aforementioned uniform size distribution of silver halide grains is a characteristic of the grains in monodispersed photographic silver halide emulsions. Silver halide grains having a narrow size distribution can be obtained by controlling the conditions at which the silver halide grains are prepared using a doublerun procedure. In such a procedure, the silver halide grains are prepared by simultaneously running an aqueous solution of a silver salt, such as silver nitrate, and an aqueous solution of a water-soluble halide, for example, an alkali metal halide such as potassium bromide, into a rapidly agitated aqueous solution of a silver halide peptizer, preferably gelatin, a gelatin derivative or some other protein peptizer. The pH and the pAg employed in this type of procedure are interrelated. For example, changing one while maintaining the other constant at a given temperature can change the size frequency distribution of the silver halide grains which are formed. However, generally the temperature is about 30° to about 90° C., the pH is up to about 9, preferably 4 or less, and the pAg is up to about 9.8. Suitable methods for preparing photographic silver halide emulsions having the required uniform particle size are disclosed in an article entitled "Ia: Properties of Photographic Emulsion Grains," by Klein and Moisar, The Journal of Photographic Science, Vol. 12, 1964, pp. 242–251; an article entitled "The Spectral Sensitization of Silver Bromide Emulsions on Different Crystallographic Faces," by Markocki, The Journal of Photographic Science, Vol. 13, 1965, pp. 85–89; an article entitled "Studies on Silver Bromide Sols, Part I. The Formation and Aging of Monodispersed Silver Bromide Sols," by Ottewill and Woodbridge, The Journal of Photographic Science, Vol. 13, 1965, pp. 98–103; and an article entitled "Studies on Silver Bromide Sols, Part II. The Effect of Additives on the Sol Particles," by Ottewill and Woodbridge, The Journal of Photographic Science, Vol. 13, 1965, pp. 104–107.

Where internal latent image sites have been formed through internal chemical sensitization or the use of metal dopants, the surface chemical sensitization of the silver halide grains can be below that which will produce substantial density in a surface developer—that is, less than 0.4 when coated, exposed and surface developed as described above. The silver halide grains are preferably predominantly silver bromide grains chemically surface sensitized to a level which would provide a maximum density of at least 0.5 using undoped silver halide grains of the same size and halide composition when coated, exposed and developed as described above.

Surface chemical sensitization can be undertaken using techniques such as those disclosed by Sheppard, Waller et al., McVeigh or Dunn, cited above. The silver halide grains can also be surface sensitized with salts of the noble metals, such as ruthenium, palladium and platinum. Representative compounds are ammonium chloropalladate, potassium chloroplatinate and sodium chloropalladite, which are used for sensitizing in amounts below that which produces any substantial fog inhibition, as described in Smith and Trivelli U.S. Pat. No. 2,448,060, issued Aug. 31, 1948, and as antifoggants in higher amounts, as described in Trivelli and Smith U.S. Pat. No. 2,566,245 issued Aug. 28, 1951 and U.S. Pat. No. 2,566,263, issued Aug. 28, 1951. The silver halide grains can also be chemically sensitized with reducing agents, such as stannous salts (Carroll U.S. Pat. No. 2,487,850, issued Nov. 15, 1949), polyamines, such as diethylene triamine (Lowe et al. U.S. Pat. No. 2,518,698, issued Aug. 15, 1950), polyamines, such as spermine (Lowe et al. U.S. Pat. No. 2,521,925, issued Sept. 12, 1950), or bis($\beta$-aminoethyl)sulfide and its water-soluble salts (Lowe et al. U.S. Pat. No. 2,521,926, issued Sept. 12, 1950).

The internal latent image silver halide grains can be optically sensitized using conventional techniques. For instance, spectral sensitization can be obtained by treating the silver halide grains with a solution of a sensitizing dye in an organic solvent or the dye may be added in the form of a dispersion as described in Owens et al. British Patent No. 1,154,781 published June 11, 1969.

Sensitizing dyes useful in sensitizing silver halide emulsions are described, for example, in Brooker et al. U.S. Pat. No. 2,526,632, issued Oct. 24, 1950; Sprague U.S. Pat. No. 2,503,776, issued Apr. 11, 1950; Brooker et al. U.S. Pat. No. 2,493,748, issued Jan. 10, 1950; and Taber et al. U.S. Pat. No. 3,384,486, issued May 21, 1968. Spectral sensitizers which can be used include the cyanines, merocyanines, complex (tri- or tetranuclear) cyanines, allopolar cyanines, styryls, hemicyanines (e.g., enamine hemicyanines) oxonols and hemioxonols.

Preferred optical sensitizers include cyanine and merocyanine dyes, such as those described in U.S. Pat. Nos. 1,846,301 and 1,846,302, both issued Feb. 23, 1932, and 1,942,854, issued Jan. 9, 1934, all by Brooker; 1,990,507 by White, issued Feb. 12, 1935; 2,112,140, issued Mar. 22, 1938; 2,165,338, issued July 11, 1939, 2,493,747, issued Jan. 10, 1950, and 2,739,964, issued Mar. 27, 1956, all by Brooker et al; 2,493,748 by Brooker et al, issued Jan. 10, 1950; 2,503,776, cited above; and 2,519,001, issued Aug. 15, 1950, both by Sprague; 2,666,761 by Heseltine et al., issued Jan. 19, 1954; 2,734,900, by Heseltine, issued Feb. 14, 1956; and 2,739,149 by Van Lare issued Mar. 20, 1956; and Kodak Limited British Patent No. 450,958 accepted July 15, 1936.

To obtain the benefits of this invention, the internal latent image silver halide grains and nucleating agent of this invention are brought together in a radiation sensitive layer of a photographic element. In a preferred form of the invention, the silver halide grains and the nucleating agent of the invention are incorporated in a radiation-sensitive silver halide emulsion of a type employed in photography. Techniques for forming photographic silver halide emulsions are generally well known to those skilled in the art. Techniques for forming and washing silver halide emulsions are generally taught in Product Licensing Index, Vol. 92, December 1971, publication 9232, paragraphs I and II.

The photographic emulsions and elements described in the practice of this invention can contain various colloids alone or in combination as vehicles, as binding agents and as various layers. Suitable hydrophilic materials include both naturally occurring substances such as proteins, for example, gelatin, gelatin derivatives, cellulose derivatives, polysaccharides such as dextran, gum arabic and the like; and synthetic polymeric substances such as water-soluble polyvinyl compounds like poly(-vinylpyrrolidone), acrylamide polymers and the like.

The described photographic emulsion layers and other layers of a photographic element employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example, in U.S. Pat. Nos. 3,142,568 by Nottorf, issued July 28, 1964; 3,193,386 by White, issued July 6, 1965; 3,062,674 by Houck et al., issued Nov. 6, 1962; 3,220,844 by Houck et al., issued Nov. 30, 1965; 3,287,289 by Ream et al., issued Nov. 22, 1966; and 3,411,911 by Dykstra, issued Nov. 19, 1968; particularly effective are those water-insoluble polymers or latex copolymers of alkyl acrylates and methacrylates, acrylic acid, sulfoalkyl acrylates or methacrylates, those which have cross linking sites which facilitate hardening or curing, those having recurring sulfobetaine units as described in Canadian Patent No. 774,054 by Dykstra, and those described in U.S. Pat. No. 3,488,708 by Smith, issued Jan. 6, 1970.

The photographic emulsion layers can contain a variety of conventional photographic addenda. For example, hardeners of the type disclosed in Product Licensing Index, cited above, paragraph VII, can be employed. Similarly plasticizers, lubricants and coating aids of the type disclosed in Product Licensing Index, cited above, paragraphs XI and XII, can be employed.

The nucleating agents of this invention can be employed in any desired concentration that will permit a degree of selectivity in developing imagewise silver halide grains capable of forming an internal latent image, which grains have not been imagewise exposed, as compared to silver halide grains containing an internal latent image formed by imagewise exposure.

In a preferred form, the nucleating agents of this invention are adsorbed to the surface of the internal latent image silver halide grains and employed in concentrations ranging from 0.05 to 20 mmoles per mole of silver. Preferably 0.10 to 10 mmoles of adsorbed nucleating agent per mole of silver is employed and, most preferably, 0.25–2.5 mmoles of adsorbed nucleating agent per mole of silver. Optimum concentrations can, of course, vary somewhat from one application to another. The nucleating agent is adsorbed to the surface of the silver halide grains using the procedures well known to those skilled in the art for adsorbing sensitizing dyes, such as cyanine and merocyanine dyes, to the surface of silver halide grains.

It is specifically contemplated to employ in combination with the nucleating agents of this invention other conventional nucleating agents. In a specifically preferred form one or a combination of nucleating agents of this invention are employed at a concentration of up to about 20 mmoles per mole of silver, as indicated above, in combination with a conventional substituted hydrazine type nucleating agent which is present in a concentration of from about 200 mg to about 2 grams per mole of silver.

In one preferred form, the nucleating agents of this invention are employed in combination with hydrazide and hydrazone nucleating agents of the type disclosed by Whitmore, cited above, U.S. Pat. No. 3,227,552, issued Jan. 4, 1966, the disclosure of which is hereby incorporated by reference.

Illustrative specific hydrazide (named as hydrazine derivatives) and hydrazone nucleating agents useful in the practice of this invention include those set forth in Table II of Leone et al., U.S. Pat. No. 4,030,925, issued June 21, 1977, the disclosure of which is hereby incorporated by reference.

In another preferred form, the nucleating agents of this invention are employed in combination with N-substituted cycloammonium quaternary salts of the type disclosed by Kurtz, Harbison, Heseltine and Lincoln, U.S. Pat. No. 3,734,738 cited above, the disclosure of which is hereby incorporated by reference.

Illustrative specific N-substituted quaternary ammonium salt nucleating agents useful in the practice of this invention include those set forth in Table III of Leone et al., U.S. Pat. No. 4,030,925, cited above.

To form a photographic element according to the present invention it is merely necessary to coat onto a conventional photographic support a radiation-sensitive composition comprised of internal latent image silver halide grains and a nucleating agent of this invention. Conventional photographic supports, including film and paper photographic supports, are disclosed in Product Licensing Index, cited above, paragraph X.

A simple exposure and development process can be used to form a direct-positive image. In one embodiment, a photographic element comprising at least one layer of a silver halide composition as described above can be imagewise exposed and then developed in a silver halide surface developer.

It is understood that the term "surface developer" encompasses those developers which will reveal the surface latent image on a silver halide grain, but will not reveal substantial internal latent image in an internal image-forming emulsion, and under the conditions generally used to develop a surface-sensitive silver halide emulsion. The surface developers can generally utilize any of the silver halide developing agents or reducing agents, but the developing bath or composition is generally substantially free of a silver halide solvent (such as water-soluble thiocyanates, water-soluble thioethers, thiosulfates, ammonia and the like) which will crack or dissolve the grain to reveal substantial internal image. Low amounts of excess halide are sometimes desirable in the developer or incorporated in the emulsion as halide-releasing compounds, but high amounts of iodide or iodide-releasing compounds are generally avoided to prevent substantial cracking of the grain.

Typical silver halide developing agents which can be used in the developing compositions of this invention include hydroquinones, catechols, aminophenols, 3-pyrazolidones, ascorbic acid and its derivatives, reductones, phenylenediamines and the like or combinations thereof. The developing agents can be incorporated in the photographic elements wherein they are brought in contact with the silver halide after imagewise exposure; however, in certain embodiments they are preferably employed in the developing bath.

The developing compositions used in the process of this invention can also contain certain antifoggants and development restrainers, or optionally they can be incorporated in layers of the photographic element. For example, in some applications improved results can be obtained when the direct-positive emulsions are processed in the presence of certain antifoggants as disclosed in U.S. Pat. No. 2,497,917, which is incorporated herein by reference.

Typical useful antifoggants include benzotriazoles, such as benzotriazole, 5-methylbenzotriazole, 5-ethylbenzotriazole and the like, benzimidazoles such as 5-nitrobenzimidazole, and the like, benzothiazoles such as 5-nitrobenzothiazole, 5-methylbenzothiazole and the like, heterocyclic thiones such as 1-methyl-2-tetrazoline-5-thione and the like, triazines such as 2,4-dimethylamino-6-chloro-5-triazine and the like, benzoxazoles such as ethylbenzoxazole and the like, and pyrroles such as 2,5-dimethylpyrrole and the like.

In certain embodiments, good results are obtained when the elements are processed in the presence of high levels of the antifoggants mentioned above. When antifoggants such as benzotriazoles are used, good results can be obtained when the processing solution contains up to 5 g/l and preferably 1 to 3 g/l; when they are incorporated in the photographic element, concentrations of up to 1000 mg/mole of Ag and preferably concentrations of 100 to 500 mg/mole of Ag are employed.

It is, of course, known in the art that nucleating agents can be incorporated into surface developers in forming direct-positive images. While the nucleating agents of this invention could conceivably be incorporated into surface developers, it is our view that superior results are obtainable by incorporating the nucleating agents of this invention in the photographic element prior to development. It is, however, recognized that the other conventional nucleating agents discussed above for use in combination with the nucleating agents of this invention could be incorporated in the surface developer, wholly or partially, rather than being incorporated in the photographic element. It is preferred that the nucleating agents be entirely incorporated in the photographic element as opposed to the surface developer in most applications.

This invention may be used with elements designed for color photography, for example, elements containing color-forming couplers such as those described in U.S. Pat. Nos. 2,376,679 by Frohlich et al., 2,322,027 by Jelley et al., 2,801,171 by Fierke et al., 2,698,794 by Godowsky, 3,227,554 by Barr et al. and 3,046,129 by Graham et al.; or elements to be developed in solutions containing color-forming couplers such as those described in 2,252,718 by Mannes et al., 2,592,243 by Carroll et al. and 2,950,970 by Schwan et al.; and in false-sensitized color materials such as those described in U.S. Pat. No. 2,763,549 by Hanson.

This invention is useful with photographic elements used in image transfer processes or in image transfer film units. Generally the invention can be used with the color image transfer processes and the film units as described in Whitmore U.S. Pat. Nos. 3,227,550 and 3,227,552 issued Jan. 4, 1966; U.S. Pat. No. 2,983,606; U.S. Pat. No. 2,543,181; Whitmore Canadian Patent No. 674,082; Belgian Patent Nos. 757,959 and 757,960 both issued Apr. 23, 1971, and the like.

The silver halide emulsions as described herein are particularly useful in combination with negative working image dye providing materials, i.e., those materials which produce a negative pattern of transferred image dye when used in combination with a negative-working silver halide emulsion. Typical useful negative-working image dye providing materials are disclosed in Fleckenstein U.S. Pat. application No. B351,673, published Jan. 28, 1975; U.S. Pat. No. 3,698,897, issued Oct. 17, 1972, of Gompf and Lum; U.S. Pat. No. 3,728,113, issued Apr. 17, 1973, of Becker et al.; U.S. Pat. No. 3,725,062, issued Apr. 3, 1973, of Anderson and Lum; U.S. Pat. No. 3,148,062, issued Sept. 8, 1964, of Whitmore et al.; U.S. Pat. Nos. 3,628,952 and 3,844,785; and German OLS 2,317,134.

The direct positive silver halide emulsions of this invention are preferably used in combination with negative-working dye providing materials because the combination produces a positive transfer image. However, it is recognized that the direct positive emulsions can also be used with positive-working image dye providing materials such as dye developers as disclosed in U.S. Pat. No. 2,983,606, oxichromic developers as disclosed in U.S. Pat. No. 3,880,658, shifted dye developers as disclosed in U.S. Pat. No. 4,199,354; and the like. Positive images are obtained in the exposed silver halide emulsion layers while a transferred negative image is obtained where the direct positive emulsions are used in combination with negative-working image dye providing materials. Also, where the exposure is made of a negative image or through a negative image record, positive transfer images are obtained with the combination of direct positive emulsions and positive-working image dye providing materials.

In highly preferred embodiments, the film units of this invention contain a support having thereon a layer containing a blue-sensitive emulsion having associated therewith a yellow image dye-providing material, a red-sensitive silver halide emulsion having associated therewith a cyan image dye-providing material, and a green-sensitive emulsion having associated therewith a magenta image dye-providing material, and preferably all of said image dye-providing materials are initially immobile image dye-providing materials.

The terms "mobile" (or "diffusible") and "immobile" (or "nondiffusible") as used herein refer to compounds which are incorporated in the photographic element and, upon contact with an alkaline processing solution, are substantially diffusible or substantially immobile, respectively, in the hydrophilic colloid layers of a photographic element.

The term "image dye-providing material" as used herein is understood to refer to those compounds which are employed to form dye images in photographic elements. These compounds include dye developers, shifted dyes, color couplers, oxichromic compounds, dye redox releasers, etc.

In one preferred embodiment, the silver halide emulsions of the invention are used in association with immobile redox dye-releaser image dye-providing compounds. The immobile redox dye-releasers undergo oxidation followed, in certain instances, by hydrolysis to provide an imagewise distribution of a mobile image dye. Compounds of this type can be used with direct-positive emulsions to form negative image records in the exposed photographic element and will provide a positive image in diffusible dye for transfer to an image-receiving layer, such as in a diffusion transfer photographic element. Typical useful compounds of this type are disclosed in Whitmore et al. Canadian Patent No. 602,607, issued Aug. 2, 1960; Fleckenstein et al. U.S.

Ser. No. B351,700, published Jan. 28, 1975; and U.S. Pat. Nos. 3,698,897, 3,728,113, 3,725,062, 3,227,552, 3,443,939, 3,443,940 and 3,443,941, and the like, all of which are incorporated herein by reference. Where the receiver layer is coated on the same support with the photosensitive silver halide layers, the support is preferably a transparent support, an opaque layer is preferably positioned between the image-receiving layer and the photosensitive silver halide layer, and the alkaline processing composition preferably contains an opacifying substance such as carbon or a pH-indicator dye which is discharged into the film unit between a dimensionally stable support or cover sheet and the photosensitive element.

In certain embodiments, the cover sheet can be superposed or is adapted to be superposed on the photosensitive element. The image-receiving layer can be located on the cover sheet so that it becomes an image-receiving element. In certain preferred embodiments where the image-receiving layer is located in the photosensitive element, a neutralizing layer is located on the cover sheet.

A means for discharging the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like.

It is known in the art that neutralizing layers containing acidic materials, such as polymeric acids, monomeric acids, hydrolyzable materials and the like, can be positioned within an image-transfer film unit to effect shutdown of development of silver halide and transfer of the image dye-providing substance. Neutralizing layers can also be used in the film units of the present invention, including acid layers positioned between timing layers to delay neutralization of the element, acid layers positioned near the image-receiving layer, acid layers on a cover sheet used to distribute the processing composition uniformly over the photosensitive element, acid layers within the photosensitive element, and the like.

The photographic emulsions and elements of this invention are described by the generic designation direct-positive. The term "direct reversal" has recently been employed in the art to distinguish direct-positive emulsions and elements which contain unfogged silver halide grains and nucleating agents from direct-positive silver halide emulsions and elements containing surface fogged silver halide grains. It is to be understood that this invention is directed to direct-reversal photographic emulsions and elements.

The invention can be further illustrated by the following examples.

EXAMPLES

Preparation of Nucleating Agent

A. (NA-I) 2-Acetoxy-1,2-di-(2-pyridyl)ethanone

This nucleating agent was prepared as described by F. Cramer and W. Krum, Chem. Ber. 86, 1586–92 (1963), the disclosure of which is hereby incorporated by reference, m.p. 119°–120° C.

B. (NA-II) 2-Acetoxy-1,2-di-(3-pyridyl)ethanone

To 100 g (0.935 mole) 3-pyridinecarboxaldehyde in 500 cc. acetic anhydride was added 20 g KCN and 10 drops concentrated $H_2SO_4$. The mixture was refluxed for 2 hours and allowed to stand overnight. The resulting mixture was treated with successive portions of ethanol which were evaporated. The black residue was mixed with benzene and the inorganic solid which separated was filtered off. A portion of the extract was chromatographed on alumina using ethyl acetate-benzene as eluant, yielding two fractions, A, $R_f$0.93, and B, $R_f$ 0.62. Fraction B solidified and was recrystallized from methanol to yield 30 g of compound NA-II, m.p. 136°–138° C.

C. (NA-III) 2-Benzoxy-1,2-di-(2-pyridyl)ethanone

In the preparation of the corresponding dibenzoxylated compound as described by F. Cramer and W. Krum, Chem. Ber. 86, 1586–92 (1953), concentration of the mother liquor produced the monobenzoyl compound, NA-III, m.p. 138°–141° C. After recrystallization from ethyl acetate-ether, the m.p. was 137°–139° C.

D. (NA-IV) 1,2-Didecanoyloxy-1,2-di-(2-pyridyl)ethene

To 21.0 g (0.1 mole) of pulverized α-pyridoin (commercially available, e.g. from Aldrich Chemical Co.) was added 9.5 g (0.05 mole) decanoyl chloride. The reaction mixture was mixed for 30 minutes, after which it became solid. The solid was extracted with acetonitrile and the acetonitrile solution evaporated to yield an oily semisolid. Recrystallization from 70% cyclohexanone-30% acetone yielded 1.3 g (9.9%) white fine needles of compound NA-IV, m.p. 89°–90° C.

E. (NA-V) 2-Chloroacetoxy-1,2-di-(2-pyridyl)ethanone

Chloroacetyl chloride (1.4 g, 0.0123 mole) in an equal amount of dry acetonitrile was added dropwise with stirring to 5.4 g (0.0252 mole) of α-pyridoin in 50 ml of dry acetonitrile. The reaction mixture was stirred one hour. The orange solid was filtered off and washed with acetonitrile.

Evaporation of the solvent from the filtrate yielded a yellow oil. This was dissolved with heating in hexane-acetone, filtered, and hexane was added until the solution became slightly cloudy. After standing under refrigeration, 700 mg (20%) of compound NA-V was collected, m.p. 100°–102° C.

F. (NA-IV) 2-(4-Cyanobenzoxy)-1,2-di-(2-pyridyl)ethanone

To 2.14 g (0.01 mole) of α-pyridoin in 50 ml of acetonitrile was added 0.80 g (0.01 mole) of pyridine and then 1.65 g (0.01 mole) of p-cyanobenzoyl chloride portionwise with stirring. Stirring was continued for ½ hour. Then 150 ml of dichloromethane was added, the organic phase washed thoroughly with water, dried and evaporated to an oily solid residue. The residue was stirred with 80% hexane and 20% acetone to obtain a solid, 1.7 g (50%). After recrystallization from hexane-acetone, 0.9 g (53%), m.p., 152°–154° C., of NA-VI was recovered.

Use of Nucleating Agents in Photographic Elements

EXAMPLE 1

A control photographic element, Element A, was prepared by coating the following emulsion layer on a cellulose acetate film support: a direct positive, internal image gelatin-silver bromide emulsion of the type described in U.S. Pat. No. 3,761,276 (0.75 μm octahedra) prepared by a core shell procedure. The core was sulfur and gold sensitized, and the shelled grains were sulfur sensitized. The emulsion was coated onto the support at 4.1 g/m² Ag, 5.8 g/m² gelatin. Element A contained no nucleating agent.

Element B was identical to Element A except that it contained 1.87 mmole/mole Ag of unesterified α-pyridoin, having the formula:

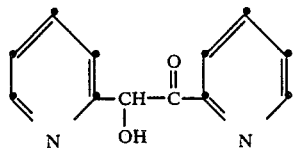

Element 1 of this invention was identical to Element A except that it contained 0.47 mmole/mole Ag of the compound NA-I.

Element 2 of this invention was identical to Element 1 except that it contained 1.87 mmole/mole Ag of the compound NA-I.

Element 3 of this invention was identical to Element A except that it contained 0.47 mmole/mole Ag of the compound NA-II.

Element 4 of this invention was identical to Element 3 except that it contained 1.87 mmole/mole Ag of the compound NA-II.

Element 5 of this invention was identical to Element A except that it contained 0.47 mmole/mole Ag of the compound NA-III.

Element 6 of this invention was identical to Element 5 except that it contained 1.87 mmole/mole Ag of the compound NA-III.

Element 7 of this invention was identical to Element A except that it contained 0.47 mmole/mole Ag of the compound NA-IV.

Element 8 of this invention was identical to Element 7 except that it contained 1.87 mmole/mole Ag of the compound NA-IV.

Samples of these coatings prepared as described above were exposed for 0.1 second to a 5500° K., 500 W tungsten source using an Eastman 1B Sensitometer. The exposed coatings were developed in Developer A for 3 minutes at 68° F., fixed, washed and dried. The composition of Developer A was as follows:

| Developer A | |
|---|---|
| Component | Concentration g/L |
| Hydroquinone | 10 |
| Elon | 5 |
| Sodium sulfite | 70 |
| Potassium bromide | 2.5 |
| pH adjusted to 13.2 with sodium hydroxide | |

The sensitometric results are set forth in Table 1.

TABLE 1

| Element | Nucleating Agent (Conc. mmole/mole Ag) | | Dmax | Dmin |
|---|---|---|---|---|
| A Control | None | | .21 | .21 |
| B | | | .25 | .23 |
| 1 | NA-I | (0.47) | .47 | .23 |
| 2 | NA-I | (1.87) | 1.06 | .26 |
| 3 | NA-II | (0.47) | .27 | .23 |
| 4 | NA-II | (1.87) | 1.09 | .74 |
| 5 | NA-III | (0.47) | .36 | .22 |
| 6 | NA-III | (1.87) | .36 | .23 |
| 7 | NA-IV | (0.47) | .41 | .23 |
| 8 | NA-IV | (1.87) | 1.15 | .23 |

The nucleating agents of this invention, NA-I, NA-II, NA-III, and NA-IV gave slight to excellent reversal image discrimination. Element B containing α-pyridoin yielded virtually no reversal image discrimination.

EXAMPLE 2

The coatings of Example 2 were prepared and tested as described for Example 1, except that the exposed coatings were developed for 5 minutes, with the nucleating agents as designated in Table 2. The sensitometric results for these coatings also are set forth in Table 2.

TABLE 2

| Element | Nucleating Agent (Conc. mmole/mole Ag) | | Dmax | Dmin |
|---|---|---|---|---|
| C | None | — | .48 | .45 |
| 9 | NA-I | (1.87) | 1.54 | .65 |
| 10 | NA-V | (0.47) | .57 | .44 |
| 11 | NA-V | (1.87) | .78 | .69 |
| 12 | NA-VI | (0.47) | .62 | .40 |
| 13 | NA-VI | (1.87) | .79 | .51 |

The results indicate that chloro-substitution of compound NA-I results in elimination of some of the nucleating activity. Cyano-substitution of the benzoxy group of compound NA-III, however, does not reduce its reversal activity.

The invention has been described with particular reference to preferred embodiments thereof, but it will be understood that variations and modifications can be effected within the spirit and scope of the invention.

What is claimed is:

1. A radiation-sensitive silver halide emulsion comprising a binder, silver halide grains capable of forming an internal latent image when coated in a photographic element and exposed to actinic radiation, and a nucleating amount of a nucleating agent having the formula:

$$R^1—Y—R^2$$

wherein $R^1$ and $R^2$ independently represent a heterocyclic group having at least one nitrogen ring atom;

Y is $-\overset{R^3-O}{\overset{|}{CH}}-\overset{O}{\overset{\|}{C}}-$ or $-\overset{R^3-O}{\overset{|}{C}}=\overset{O-R^4}{\overset{|}{C}}-$ where $R^3$ is a $-\overset{O}{\overset{\|}{C}}-R^5$ group or a $-\overset{O}{\overset{\|}{C}}-\overset{O}{\overset{\|}{C}}-R^5$ group;

$R^4$ is H, a $-\overset{O}{\overset{\|}{C}}-R^5$ group or a $-\overset{O}{\overset{\|}{C}}-\overset{O}{\overset{\|}{C}}-R^5$ group;

and $R^5$ is alkyl, alkoxy, aryl or aralkyl, and wherein Y is attached to a carbon ring atom of each of said heterocyclic groups.

2. A photographic element comprising a support having thereon a layer comprising a radiation-sensitive silver halide emulsion comprising a binder, silver halide grains capable of forming an internal latent image when coated in a photographic element and exposed to actinic radiation, and a nucleating amount of a nucleating agent having the formula:

$$R^1—Y—R^2$$

wherein $R^1$ and $R^2$ independently represent a heterocyclic group having at least one nitrogen ring atom;

Y is $-\overset{R^3-O}{\overset{|}{CH}}-\overset{O}{\overset{\|}{C}}-$ or $-\overset{R^3-O}{\overset{|}{C}}=\overset{O-R^4}{\overset{|}{C}}-$ where $R^3$ is a $-\overset{O}{\overset{\|}{C}}-R^5$ group or a $-\overset{O}{\overset{\|}{C}}-\overset{O}{\overset{\|}{C}}-R^5$ group;

$R^4$ is H, a $-\overset{O}{\overset{\|}{C}}-R^5$ group or a $-\overset{O}{\overset{\|}{C}}-\overset{O}{\overset{\|}{C}}-R^5$ group;

and $R^5$ is alkyl, alkoxy, aryl or aralkyl, and wherein Y is attached to a carbon ring atom of each of said heterocyclic groups.

3. A photographic diffusion transfer element comprising a support having thereon a layer comprising a redox dye-releasing compound having associated therewith an internal latent image silver halide emulsion comprising a binder, internal latent image silver halide grains and a nucleating amount of a nucleating agent having the formula:

$R^1-Y-R^2$ wherein $R^1$ and $R^2$ independently represent a heterocyclic group having at least one nitrogen ring atom;

Y is $-\overset{R^3-O}{\overset{|}{CH}}-\overset{O}{\overset{\|}{C}}-$ or $-\overset{R^3-O}{\overset{|}{C}}=\overset{O-R^4}{\overset{|}{C}}-$ where $R^3$ is a $-\overset{O}{\overset{\|}{C}}-R^5$ group or a $-\overset{O}{\overset{\|}{C}}-\overset{O}{\overset{\|}{C}}-R^5$ group;

$R^4$ is H, a $-\overset{O}{\overset{\|}{C}}-R^5$ group or a $-\overset{O}{\overset{\|}{C}}-\overset{O}{\overset{\|}{C}}-R^5$ group;

and $R^5$ is alkyl, alkoxy, aryl or aralkyl, and wherein Y is attached to a carbon ring atom of each of said heterocyclic groups; and a dye image-receiving layer.

4. A photographic film unit comprising (a) an integral imaging receiver element comprising a support, an internal latent image silver halide emulsion comprising a binder, internal latent image silver halide grains and a nucleating amount of a nucleating agent having the formula:

$R^1-Y-R^2$ wherein $R^1$ and $R^2$ independently represent a heterocyclic group having at least one nitrogen ring atom;

Y is $-\overset{R^3-O}{\overset{|}{CH}}-\overset{O}{\overset{\|}{C}}-$ or $-\overset{R^3-O}{\overset{|}{C}}=\overset{O-R^4}{\overset{|}{C}}-$ where $R^3$ is a $-\overset{O}{\overset{\|}{C}}-R^5$ group or a $-\overset{O}{\overset{\|}{C}}-\overset{O}{\overset{\|}{C}}-R^5$ group;

$R^4$ is H, a $-\overset{O}{\overset{\|}{C}}-R^5$ group or a $-\overset{O}{\overset{\|}{C}}-\overset{O}{\overset{\|}{C}}-R^5$ group;

and $R^5$ is alkyl, alkoxy, aryl or aralkyl, and wherein Y is attached to a carbon ring atom of each of said heterocyclic groups, a redox dye-releasing compound associated with said emulsion, and a dye image-receiving layer;

(b) a cover sheet comprising a timing layer, a neutralizing layer and a support; and (c) means for discharging an aqueous alkaline processing composition between the integral imaging receiver element and the cover sheet.

5. The invention of claim 1, 2, 3, or 4 wherein $R^1$ and $R^2$ independently are selected from the group consisting of pyridyl, pyrazinyl, quinolyl, benzimidazolyl, triazinyl, pyrazolyl, pyrimidyl and pyrrolidyl.

6. The invention of claim 1, 2, 3 or 4 wherein said nucleating agent is present in a concentration ranging from 0.05 to 20 mmoles per mole of said silver.

7. The invention of claim 1, 2, 3 or 4 wherein said nucleating agent is selected from the group consisting of 2-acetoxy-1,2-di-(2-pyridyl)ethanone,
2-acetoxy-1,2-di-(3-pyridyl)ethanone,
2-benzoxy-1,2-di-(2-pyridyl)ethanone,
1,2-didecanoyloxy-1,2-di-(2-pyridyl)ethene,
2-chloroacetoxy-1,2-di-(2-pyridyl)ethanone and
2-(4-cyanobenzoxy)-1,2-di-(3-pyridyl)ethanone.

* * * * *